United States Patent [19]

Carey et al.

[11] Patent Number: 4,814,204

[45] Date of Patent: Mar. 21, 1989

[54] NOTCHED DOCTORED SINGLE KISS ROLL APPLICATOR

[75] Inventors: Francis J. Carey, West Chester; Nancy A. Cordrey, Glen Mills; James J. Hipkins, Prospect Park, all of Pa.

[73] Assignee: Scott Paper Company, Philadelphia, Pa.

[21] Appl. No.: 116,596

[22] Filed: Nov. 2, 1987

[51] Int. Cl.[4] ..... B05D 5/00; B05D 3/12; B05C 1/00

[52] U.S. Cl. ..... 427/286; 118/204; 118/261; 427/288; 427/359; 427/360; 427/428

[58] Field of Search ..... 118/204, 261; 427/359, 427/360, 428, 288, 256, 286

[56] References Cited

U.S. PATENT DOCUMENTS 2,102,984 12/1937 Von Hoffe ..... 118/204

2,754,796 7/1956 Faulkner et al. ..... 118/204

*Primary Examiner*—Janyce A. Bell

*Attorney, Agent, or Firm*—John A. Weygandt; John W. Kane, Jr.

[57] ABSTRACT

An apparatus for applying spaced apart discontinuous stripes of a fluid to the surface of a moving web. The apparatus includes a rotating applicator roll partially immersed in a bath of the fluid. A notched doctor blade in contact with the surface of the roll removes fluid from the surface of the roll except in the region of the notches to form spaced apart circumferential beads of the fluid on the surface of the roll. The moving web partially wraps the applicator roll where the beads are formed, but is travelling between 20 to 200 times the speed of the surface of the applicator roll, which results in a relatively even distribution of the fluid, in the form of a discontinuous stripe, on the surface of the web.

9 Claims, 1 Drawing Sheet

NOTCHED DOCTORED SINGLE KISS ROLL APPLICATOR

TECHNICAL FIELD

This invention relates in general to an apparatus and a method for applying very small quantities of a fluid to the surface of a moving web. More particularly, this invention relates to the application of quantities of a fluid to a moving sanitary paper web using a notched doctored, single roll, kiss coater.

BACKGROUND ART

As disclosed in Coating Equipment and Processes by George L. Booth, published by Lockwood Publishing, Inc., at pages 75–82, and in Coating and Laminating Machines, by Herbert L. Weiss, published by Converting Technology Company, at pages 165–170, it is well known to use single roll, kiss coaters to apply fluid to the surface of a moving paper web.

U.S. Pat. No. 3,647,525-Dahlgren, at FIG. 1 and at column 5, lines5–11, discloses that it is old to use a doctor blade to wipe off excess fluid from the surface of a single roll kiss coater and to smooth out the film of liquid adhering to the surface of the roll before the film of liquid is rotated into contact with the moving web.

It has been found that the doctored roll coaters as described by Booth, Weiss and Dahlgren are unable to apply certain fluid materials such as emollient fluids in small quantities, in the range of several grams per square meter, with uniformity to the surface of a moving sanitary tissue or towel web. By uniformity, it is not meant that the entire surface of the paper must be coated with the fluid but that there not be large untreated surface areas approximating the shape of an adult human hand. In trying to utilize the doctored roll coating techniques as disclosed by Booth, Weiss and Dahlgren, to apply small quantities of a liquid to a web, it has been found that many large areas were left untreated. Although this problem could be solved by removing less liquid from the applicator roll, this results in more fluid being applied to the web than desired.

Booth, at page 75, states that kiss coaters are normally limited to 500 to 600 while at page 452 he states that the kiss roll can be used at a maximum speed of 1000, it being presumed that in both cases Booth is referring to the web speed in feet per minute. At page 81, Booth states that the speed of the applicator roll varies from 10 per cent to 60 percent of the speed of the web, or in other words, the web is travelling between 1.6 to 10 times the surface speed of the roll.

Both Booth, at page 76, and Weiss, at pages 169 and 170, disclose that fluid strips can be applied to the moving web if lifting fingers or straps are placed between the web and the roll in order to lift portions of the web off of the wetted roll.

U.S. Pat. No. 3,186,377-Schuessler discloses, at column 2, line 70, et seq., the use of a first, notched, doctor blade 22 to wipe excessive fluid from an applicator roll to provide an even distribution of fluid across the peripheral surface of the roll followed by a second blade 23 that is mounted so that its leading edge assumes a wavy configuration to provide a striped pattern of fluid that is applied to the object being coated. Other patents that disclose the use of notched blades are U.S. Pat. No. 3,511,696-Murray which discloses that a notched blade can be used to form stripes of paste which are applied to the surface of a moving web and U.S. Pat. No. 3,565,035-Burgess, et al. which discloses the use of a notched blade 92 for forming beads of glue on a glue roller 70 for application to a supply of labels. It is believed that the prior art patents to Schuessler, Murray and Burgess, et al. are concerned with applying relatively large amounts of material to the surface of the web by means of applicator rollers that have roll surface velocities that are not very different from the speed of the moving web. For example, Burgess, et al. state at column 7, lines 60–61 that the glue roller rotates slightly faster than the transfer roller.

One problem with trying to adapt the single roll kiss coater to solve this problem is that if the web is traveling at speeds of 600 to 2000 feet per minute, and the applicator roll travels at one-tenth the speed of the roll, or 60 to 200 feet per minute (18.3 to 61 meter per minute), many of the emollient fluids will begin to foam which would make the process not commercially feasible.

It is an object of this invention to apply very small amounts of a fluid to the surface of a moving web in a manner that does not leave large patches of untreated web material.

It is another object of this invention to apply an emollient fluid on the order of several grams or less to each square meter of a sanitary paper web.

It is another object of this invention to apply an emollient fluid to a sanitary paper web moving at very high speeds while keeping the surface speed of the applicator roll at a very low speed.

DISCLOSURE OF THE INVENTION

In accordance with this invention, there is provided an apparatus for applying spaced apart stripes of a fluid to the surface of a moving web. The apparatus includes a rotating applicator roll partially immersed in a bath of the fluid. A notched doctor blade in contact with the surface of the roll removes fluid from the surface of the roll except in the region of the notches to form spaced apart circumferential beads of the fluid on the surface of the roll. The moving web partially wraps the applicator roll where the beads are formed, but is travelling between 20 to 200 times the speed of the surface of the applicator roll, which results in a relatively even distribution of the fluid, in the form of discontinuous stripes, on the surface of the web.

The method of the invention comprises the steps of rotating the applicator roll, forming spaced apart circumferential beads of the fluid on the surface of the rotating roll, and then moving the web so that it partially wraps the applicator roll and travels at least 20 times faster than the surface speed of the applicator roll.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
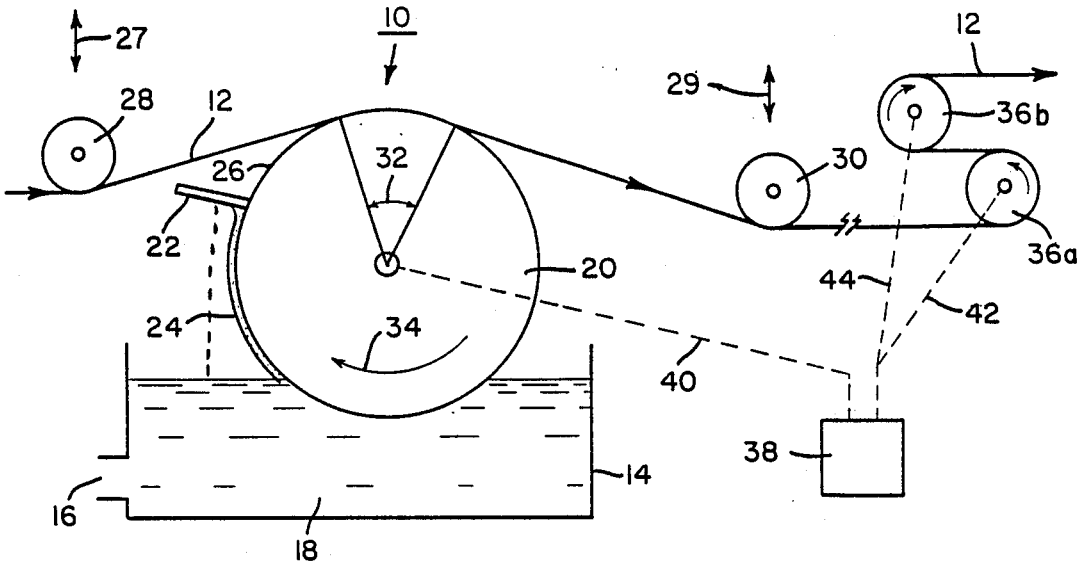
FIG. 1 is a schematic view of an apparatus for applying small quantities of a fluid material to the surface of a moving web in accordance with this invention.

FIG. 1 shows, in schematic form, an apparatus 10 for applying a fluid 18, which in a preferred embodiment is an emollient fluid, to the lower surface of a moving sanitary paper web 12. A container 14 receives the emollient fluid 18 to be applied to the web 12 through input orifice 16. The container 14 is filled to a level which immerses the lower portion of an applicator roll 20 in the fluid 18. The kiss applicator roll 20 is caused to rotate in the direction indicated by arrow 34 by motor 38 and appropriate drive means as indicated by dashed line 40.

The web 12 is pulled past the applicator roll 20 by a pair of motor driven pull rolls 36*a*, 36*b*. The web 12 comes from a source roll (not shown), which could, for example, be located at an unwind stand, passes under a guide roll 28, partially wraps the applicator roll 20 as indicated by the angle 32, passes under a second guide roll 30 and is eventually wound onto a take up roll, also not shown. As indicated by arrows 27 and 29, the guide rolls 28 and 30 can be adjusted to vary the wrap angle 32 of the web 12 around the applicator roll 20. In a preferred embodiment, pull rolls 36*a*, 36*b* are also driven by motor 38 through appropriate drive means, as indicated by dashed lines 42 and 44, so that fluctuations of the speed at which the web 12 is pulled over applicator roll 20 results in a corresponding proportional change in the surface speed of applicator roll 20.

Figure 2:
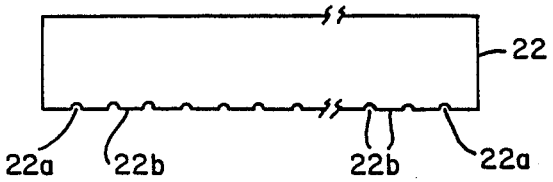
FIG. 2 is a plan view of a notched doctor blade used in the apparatus of FIG. 1.

As the rotating applicator roll 20 emerges from the fluid 18, a layer 24 of the fluid is formed along the entire length of the roll 20. As the roll 20 continues to rotate, the fluid layer 24 comes into contact with a notched doctor blade 22. The unnotched portions 22*b*, shown in FIG. 2, of the blade 22 are pressed against the surface of roll 20 so that virtually no emollient fluid passes under the unnotched portions 22*b* of the blade 22. Fluid does pass under the notched portions 22*a*, shown in FIG. 2, of blade 22. If the notches 22*a* are sized so that fluid backs up against the upstream side of the blade 22, the notches 22*a* form precise, spaced apart, circumferentially extending, beads 26 of fluid on the applicator roll 20. By precise is meant that the amount of fluid 18 within each bead 26 is determined in large part by the shape of the notches 22*a*. Thus, the total amount of fluid 18 transferred to the surface of the web 12 can be controlled by the number and the shape of the notches 22*a*. As the applicator roll 20 continues to rotate, the fluid beads 26 come into contact with the lower surface of the web 12. The material in the fluid beads 26 is transferred to the surface of the paper 12 by a wiping action of the paper 12 against the wrapped surface of the roll 20 because the surface speed of the paper 12 is anywhere from 20 to 200 times the surface speed of the roll 20.

The quantity of fluid 18 applied to the surface of web 12 is determined primarily by the size and spacing of the notches 22*a*, by the wrap angle 32, and by the relative speed of the web 12 with respect to the surface speed of the applicator roll 20. Some adjustment of the quantity of fluid applied to the surface of web 12 can be made by varying the wrap angle, or more preferably, by varying the speed of applicator roll 20.

Figure 3:
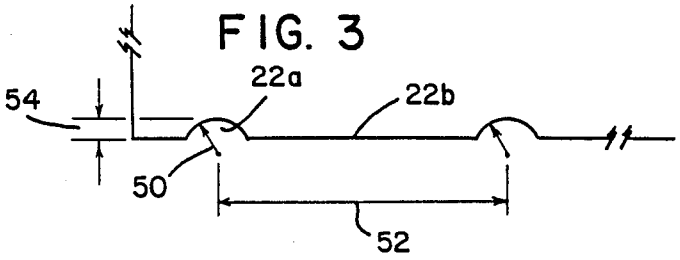
FIG. 3 is an enlarged, partial plan view of the notched doctor blade of FIG. 2.

FIG. 3 illustrates a preferred notch configuration in which the notches 22*a* are formed by segments of a circle. The notch 22*a* shape is defined by the radius 50 of a circle and a notch height 54 while the number of notches is determined by the notch to notch spacing 52.

Although FIG. 1 shows fluid being applied to only one surface of the web 12, it will be readily apparent to one skilled in the web handling art that a second applicator roll can be used to apply fluid to the upper surface of the paper web of FIG. 1. For example, the web 12 could be routed around two guide rolls so that it is travelling from right to left and above guide rolls 28, 30 in FIG. 1 with the untreated surface of the paper web 12 passing over a second doctored, single kiss roll applicator.

When the paper web 12 is an embossed paper towel having a basis weight of 32 pounds per ream of 2880 square feet (54.4 grams per square meter), most of the fluid is applied to the raised embossments which contct the fluid beads 26 on the applicator roll 20. Most of the embossments that are in line with a fluid bead 26 pick up some fluid, but there are occasional skips which can be several inches in depth. These skips tend to be random from stripe to stripe so that the possibility that an area of the web approaching the area of an adult hand is completely untreated is very low. It has also been found that when low levels of an emollient fluid are applied to the surface of an unembossed paper web, the fluid can be applied in a discontinuous stripe not unlike that applied to an embossed paper web. The resulting pattern of fluid appears as if it had been sprayed onto the web.

In one preferred embodiment, applicator roll 20 has a diameter of five inches (17.7 cm) and has a smooth, chrome surface. The notched doctor blade 22 is mounted so that the notched edge of the blade 22 contacts the roll at a point 25 degrees above the horizontal and so that the blade 22 itself makes a ten degree angle with the horizontal. The roll 20 was used to apply fluid to the surface of an embossed paper web 12 having a basis weight of about 32 pounds per ream of 2880 square feet (54.4 grams per square meter) and which is travelling at 350 feet per minute (106.7 meters per minute) and wraps the roll 20 for 34 degrees. This embodiment of the apparatus 10 was used to make the following six examples:

| | Example 1 | | Example 2 | | Example 3 | | Example 4 | | Example 5 | | Example 6 | |
|---|---|---|---|---|---|---|---|---|---|---|---|---|
| Roll speed, ft (m)/min | 8.4 | (2.44) | 8.4 | (2.44) | 2.4 | (0.73) | 6.3 | (1.92) | 4.0 | (1.22) | 2.6 | (0.79) |
| Notch radius, in (cm) | 0.025 | (0.063) | 0.038 | (0.095) | 0.038 | (0.095) | 0.025 | (0.063) | 0.025 | (0.063) | 0.025 | (0.063) |
| Notch height, in (cm) | 0.015 | (0.04) | 0.02 | (0.05) | 0.02 | (0.05) | 0.015 | (0.04) | 0.015 | (0.04) | 0.015 | (0.04) |
| Notch spacing, in (cm) | 0.25 | (0.64) | 0.25 | (0.64) | 0.25 | (0.64) | 0.25 | (0.64) | 0.25 | (0.64) | 0.25 | (0.64) |
| Fluid viscosity, centipoise | 230 | | 33 | | 30 | | 1030 | | 82,500 | | 175 | |
| Fluid quantity each side, g/m$^2$ | 0.31 | | 0.31 | | 0.29 | | 0.65 | | 0.30 | | 0.20 | |

The fluid applicator system 10 has been used to apply fluids in amounts of 0.15 grams per square meter to 0.83 grams per square meter to each surface of sanitary paper webs 12 having basis weights between 7 to 60 pounds per ream of 2880 square feet (11.9 to 102 grams per square meter). It is believed that the fluid applicator system 10 could readily apply 4 grams per square meter of a fluid to the surface by increasing the notch radius, or by decreasing the notch spacing, or by increasing the roll speed or by a combination of those three changes. Although the webs of Examples 1–6 were travelling at a speed of 350 feet per minute (107 meters per minute), it is expected that this fluid application apparatus and method can be used to apply fluids to webs travelling as fast as 3000 feet per minute (914 meters per minute) because the applicator roll 20 can be run at a surface speed between 15 to 30 feet per minute (4.6 to 9.1 meters per minute), which is below the spped at which the emollient fluids will begin to foam.

While the present invention has been described with reference to a specific embodiment thereof, it will be obvious to those skilled in the art that various changes and modifications may be made without departing from the invention in its broader aspects.

What is claimed as new and desired to be secured by Letters Patent of the United States is:

1. An apparatus for applying a liquid to a moving web comprising:

(a) a rotating applicator roll;

(b) means for forming spaced apart circumferential beads of the fluid on the surface of the roll;

(c) means for moving the web so that the web partially wraps the roll where the beads have been formed and travels at a linear speed at least 20 times greater than the surface speed of the roll whereby a uniform quantity of fluid is applied to the web in the form of discontinuous stripes.

2. The apparatus recited in claim 1 wherein the rotating applicator roll is partially submerged in the liquid thereby applying the fluid along the length of the roll and wherein the bead forming means comprises a notched doctor blade mounted to contact the surface of the roll for removing fluid and leaving circumferential beads of the fluid on the surface of the roll.

3. The apparatus recited in claim 1 wherein the web moves at a linear speed between 20 to 200 times the surface speed of the applicator roll.

4. The apparatus recited in claim 1 wherein up to 1 gram per square meter of the fluid is applied to a surface of the web.

5. The apparatus recited in claim 1 wherein up to 4 grams per square meter of the fluid is applied to a surface of the web.

6. The apparatus recited in claim 2 wherein the notches are spaced between 0.1 and 3.0 inches apart.

7. The apparatus recited in claim 2 wherein the largest width of the notches are between 0.03 and 0.15 inches.

8. A method of applying a liquid to a moving web comprising the steps of:

(a) rotating an applicator roll;

(b) forming spaced apart circumferential beads of the fluid on the surface of the roll; and (c) moving the web so that the web partially wraps the roll where the beads have been formed and travels at a linear speed that is at least 20 times greater than the surface speed of the roll.

9. A method as recited in claim 8 wherein the bead forming step is accomplished by:

(a) partially submerging the rotating applicator roll in a bath of the fluid thereby applying the fluid along the length of the roll; and (b) contacting the surface of the fluid covered roll surface with a notched doctor blade to form circumferential beads on the surface of the roll.

* * * * *